US010311836B2

(12) United States Patent
Ohba et al.

(10) Patent No.: US 10,311,836 B2
(45) Date of Patent: Jun. 4, 2019

(54) SUPPORT ASSEMBLY AND KEYBOARD APPARATUS

(71) Applicant: YAMAHA CORPORATION, Hamamatsu-shi (JP)

(72) Inventors: Akito Ohba, Hamamatsu (JP); Hiroshi Harimoto, Hamamatsu (JP); Shunsuke Ichiki, Hamamatsu (JP); Ichiro Osuga, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 3 days.

(21) Appl. No.: 15/712,228

(22) Filed: Sep. 22, 2017

(65) Prior Publication Data

US 2018/0012573 A1 Jan. 11, 2018

Related U.S. Application Data

(63) Continuation of application No. PCT/JP2016/057125, filed on Mar. 8, 2016.

(30) Foreign Application Priority Data

Mar. 25, 2015 (JP) ..... 2015-063193

(51) Int. Cl.
*G10C 3/168* (2019.01)
*G10C 1/04* (2006.01)
(Continued)

(52) U.S. Cl.
CPC ..... *G10C 3/168* (2013.01); *G10C 1/04* (2013.01); *G10C 3/163* (2013.01); *G10H 1/34* (2013.01);
(Continued)

(58) Field of Classification Search
CPC ..... G10C 3/168; G10C 3/163; G10C 1/04; G10H 1/346; G10H 1/34; G10H 2220/305
See application file for complete search history.

(56) References Cited

U.S. PATENT DOCUMENTS

| | | | | |
|---|---|---|---|---|
| 7,807,907 | B2 | 10/2010 | Inoue | |
| 2014/0020543 | A1 | 1/2014 | Oba et al. | |
| 2018/0012573 | A1* | 1/2018 | Ohba | G10C 1/04 |

FOREIGN PATENT DOCUMENTS

| | | | |
|---|---|---|---|
| GB | 463714 | A | 4/1937 |
| JP | 49002327 | U1 | 1/1974 |

(Continued)

OTHER PUBLICATIONS

International Search Report issued in Intl. Appln No. PCT/JP2016/057125 dated May 24, 2016. English translation provided.

(Continued)

*Primary Examiner* — Kimberly R Lockett
(74) *Attorney, Agent, or Firm* — Rossi, Kimms & McDowell LLP

(57) ABSTRACT

A support assembly includes a support rotatable along a first surface with respect to a support rail, a repetition lever rotatable on the support, and a jack rotatable on the support and disposed to at least partially overlaps the repetition lever. The repetition lever includes a first contact portion which makes contact with a regulating portion which regulates rotation, the jack includes a second contact portion which makes contact with the regulating portion which regulates rotation, and the repetition lever and the jack are provided so that the first contact portion and the second contact portion overlap each other.

20 Claims, 15 Drawing Sheets

(51) Int. Cl.
*G10H 1/34* (2006.01)
*G10C 3/163* (2019.01)

(52) U.S. Cl.
CPC ..... *G10H 1/346* (2013.01); *G10H 2220/305* (2013.01)

(56) References Cited

FOREIGN PATENT DOCUMENTS

| | | | |
|---|---|---|---|
| JP | S5371429 | U | 6/1978 |
| JP | H0461396 | U | 5/1992 |
| JP | H0590571 | U | 12/1993 |
| JP | 2002202773 | A | 7/2002 |
| JP | 2003228367 | A | 8/2003 |
| JP | 2004252252 | A | 9/2004 |
| JP | 2004280065 | A | 10/2004 |
| JP | 2005292361 | A | 10/2005 |
| JP | 2006171617 | A | 6/2006 |

OTHER PUBLICATIONS

Written Opinion issued in Intl. Appln. No. PCT/JP2016/057125 dated May 24, 2016. English translation provided.
International Preliminary Report on Patentability issued in Intl. Appln. No. PCT/JP2016/057125 dated Sep. 26, 2017. English translation provided.
Copending U.S. Appl. No. 15/712,273, filed Sep. 22, 2017.
Copending U.S. Appl. No. 15/712,292, filed Sep. 22, 2017.
International Search Report issued in Intl. Appln. No. PCT/JP2016/057126 dated May 24, 2016. English translation provided.
Written Opinion issued in Intl. Appln. No. PCT/JP2016/057126 dated May 24, 2016. English translation provided.
International Preliminary Report on Patentability issued in Intl. Appln. No. PCT/JP2016/057126 dated Sep. 26, 2017. English translation provided.
Office Action issued in Japanese Appln. No. 2015-063268 dated Apr. 11, 2017. Partial English translation provided.
International Search Report issued in Intl. Appln. No. PCT/JP2016/057128 dated May 31, 2016. English translation provided.
Written Opinion issued in Intl. Appln. No. PCT/JP2016/057128 dated May 31, 2016. English translation provided.
International Preliminary Report on Patentability issued in Intl. Appln. No. PCT/JP2016/057128 dated Sep. 26, 2017. English translation provided.
Office Action issued in Japanese Appln. No. 2017-092821 dated Jul. 31, 2018. English translation provided.
Office Action issued in U.S. Appl. No. 15/712,292 dated Sep. 21, 2018.
Office Action issued in U.S. Appl. No. 15/712,273 dated Oct. 31, 2018.

* cited by examiner

SUPPORT ASSEMBLY AND KEYBOARD APPARATUS

CROSS-REFERENCE TO RELATED APPLICATIONS

This application is a U.S. continuation application filed under 35 U.S.C. § 111(a), of International Application No. PCT/JP2016/057125, filed on Mar. 8, 2016, which claims priority to Japanese Patent Application No. 2015-063193, filed on Mar. 25, 2015, the disclosures of which are incorporated by reference.

FIELD

The present invention relates to a support assembly for use in a keyboard apparatus. Also, the present invention relates to the keyboard apparatus including the support assembly.

BACKGROUND

Acoustic pianos such as conventional grand pianos and upright pianos are configured of many components. Assembling these components is very complex, and thus assembling work takes long time. In particular, an action mechanism provided so as to correspond to each key requires many components, and thus its assembling work and adjustment is very complex.

For example, in the action mechanism described in Japanese Patent Application Laid-Open No. 2005-292361, a plurality of components mutual act to cause a key operation by key depressing and key releasing to be transmitted to a hammer. In particular, a support assembly configuring a part of the action mechanism operates with various components combined together. The support assembly has not only a mechanism achieving string hitting by the hammer in accordance with key depressing but also an escapement mechanism for releasing a force transmitted to the hammer by key operation immediately before key hitting. This mechanism is an important mechanism for achieving basic operation of an acoustic piano. In particular, in a grand piano, double escapement mechanism with a repetition lever and a jack combined together is generally adopted.

The operation of the action mechanism gives a sense (hereinafter also referred to as "touch feeling") to a finger of a player through a key. In particular, the configuration of the support assembly has an important influence on the touch feeling. For example, the touch feeling by operation of the escapement mechanism is called let-off.

SUMMARY

A support assembly in an embodiment of the present invention includes a support rotatable along a first surface with respect to a frame, a repetition lever rotatable on the support, and a jack rotatable on the support, the repetition lever including a first contact portion which regulates its rotating operation, the jack including a second contact portion which regulates its rotating operation, and the first contact portion and the second contact portion making contact with a common regulating portion to regulate the rotating operations of the repetition lever and the jack.

A keyboard apparatus in an embodiment of the present invention includes a plurality of support assemblies each having a support rotatable along a first surface with respect to a frame, a repetition lever rotatable on the support, and a jack rotatable on the support, the repetition lever including a first contact portion which regulates its rotating operation, the jack including a second contact portion which regulates its rotating operation, and the first contact portion and the second contact portion making contact with a common regulating portion to regulate the rotating operations of the repetition lever and the jack, and keys disposed to respectively correspond to the plurality of support assemblies to rotate the support assemblies.

DESCRIPTION OF EMBODIMENTS

Figure 1:
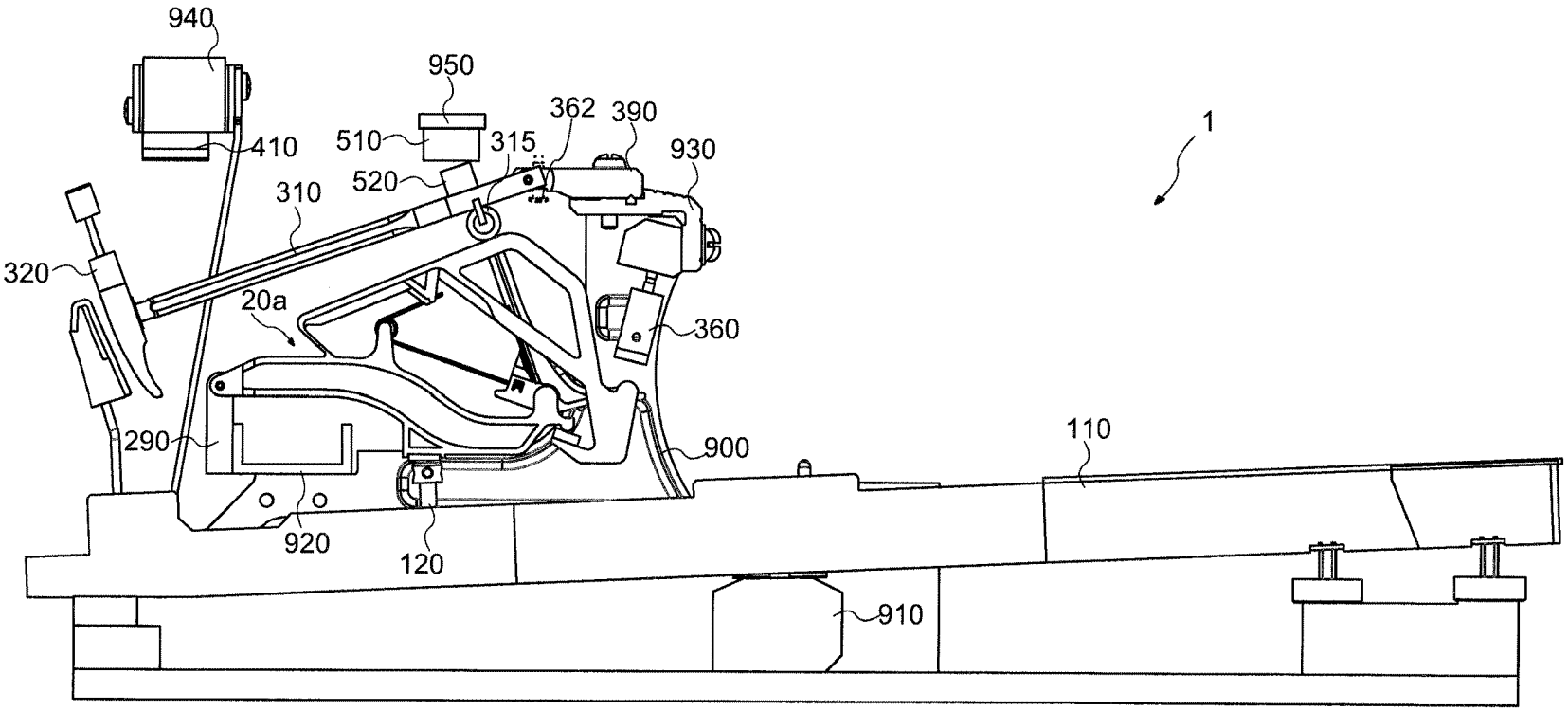
FIG. 1 is a side view showing the configuration of a keyboard apparatus in a first embodiment of the present invention.

In the following, a keyboard apparatus including a support assembly in one embodiment of the present invention is described in detail with reference to the drawings. Each embodiment described below represents one example of embodiments of the present invention, and the present invention should not be construed as being limited to these embodiments. Note that in the drawings referred to in the embodiments, same portions or portions having a similar function are provided with a same reference character or similar reference character (a reference character merely with A, B, or the like subsequent to a numeral) and repetitive description of these portions may be omitted. Also, for convenience of description, a dimensional ratio of each drawing (such as a ratio among configurations or a ratio among a vertical, lateral, and height directions) may differ from an actual ratio, and a configuration may be partially omitted from the drawing.

The double escapement mechanism in the support assembly of the keyboard apparatus is provided with a regulating screw and a regulating button which regulate rotation of the repetition lever and the jack. The regulating screw blocks the rotation of the repetition lever, and the regulating button blocks the movement of the jack.

To accurately operate the double escapement mechanism, it is required to adjust, in a series of operation of the action mechanism by key depressing, the timing when the repetition lever makes contact with the regulating screw and the timing when the jack makes contact with the regulating button for synchronization. However, the regulating screw and the regulating button are each configured of a separate component, and their attachment positions are also different. Thus, to match the timing of a contact of the repetition lever with the regulating screw and the timing of a contact of the jack with the regulating button, accurate positional adjustment is required.

An object of one embodiment of the present invention is to enhance operation stability while the structure of the support assembly is simplified. Also, an object of one embodiment of the present invention is to decrease the number of components of the support assembly and reduce manufacturing cost.

First Embodiment

Configuration of Keyboard Apparatus 1

A keyboard apparatus 1 in a first embodiment of the present invention is an example in which one example of a support assembly according to the present invention is applied to an electronic piano. This electronic piano includes a configuration similar to a support assembly included in a grand piano so as to obtain a touch feeling close to that of the grand piano at the time of key operation. By using FIG. 1, a general outline of the keyboard apparatus 1 according to the first embodiment of the present invention is described.

FIG. 1 is a side view showing a mechanical configuration of the keyboard apparatus 1 according to one embodiment of the present invention. As shown in FIG. 1, the keyboard apparatus 1 according to the first embodiment of the present invention includes a plurality of keys 110 (in this example, 88 keys) and action mechanisms corresponding to the respective keys 110. The action mechanisms each include a support assembly 20*a*, a hammer shank 310, a hammer 320, and a hammer stopper 410. Note that while FIG. 1 shows a case in which the key 110 is a white key, the same applies if the key is a black key. Also in the following description, terms representing a side closer to a player, a side farther away from the player, upper side, lower side, laterally, and so forth are defined as orientations when the keyboard apparatus is viewed from a player's side. For example, in the example shown in FIG. 1, the support assembly 20*a* is disposed on the side closer to the player when viewed from the hammer 320 and is disposed upper side when viewed from the key 110. A laterally direction corresponds to a direction in which the keys 110 are arranged.

The key 110 is rotatably supported by a balance rail 910. The key 110 rotates in a range from a rest position shown in FIG. 1 to an end position. The key 110 includes a capstan screw 120. The support assembly 20*a* is rotatably connected to a support flange 290, and is mounted on the capstan screw 120. The support flange 290 is fixed to a support rail 920. The detailed configuration of the support assembly 20 will be described further below. Note that the support flange 290 and the support rail 920 are each an example of a frame serving as a refence of rotation of the support assembly 20. The frame may be formed of a plurality of members such as the support flange 290 and the support rail 920 or may be formed of one member. The frame may be a rail-shaped member such as the support rail 920 with its direction of the length being an arrangement direction of the keys 110, or may be an independent member for each key 110, such as the support flange 290.

The hammer shank 310 is rotatably connected to a shank flange 390. The hammer shank 310 includes a hammer roller 315. The hammer shank 310 is mounted on the support assembly 20*a* via the hammer roller 315. The shank flange 390 is fixed to a shank rail 930. The hammer 320 is fixed to an end of the hammer shank 310. A regulating portion 360 is fixed to the shank rail 930 so that a contact surface makes contact with a part of the support assembly 20*a*. The regulating portion 360 is configured such that the position (height) of a contact surface which the support assembly 20*a* makes contact with is adjustable each by an adjuster. A hammer stopper 410 is fixed to a hammer stopper rail 940 and is disposed at a position of regulating the rotation of the hammer shank 310.

A sensor 510 is a sensor for measuring a position and a moving speed (in particular, a speed immediately before the hammer shank 310 collides with the hammer stopper 410) of the hammer shank 310. The sensor 510 is fixed to a sensor rail 950. In this example, the sensor 510 is a photo-interrupter. An output value from the sensor 510 changes in accordance with an amount of shielding the optical axis of the photo-interrupter by a shielding plate 520 fixed to the hammer shank 310. Based on this output value, the position and the moving speed of the hammer shank 310 can be measured. Note that, in place of or together with the sensor 510, a sensor for measuring an operation state of the key 110 may be provided.

The above-described support rail 920, shank rail 930, hammer stop rail 940, and sensor rail 950 are supported by a bracket 900.

Configuration of Support Assembly 20*a*

Figure 2:
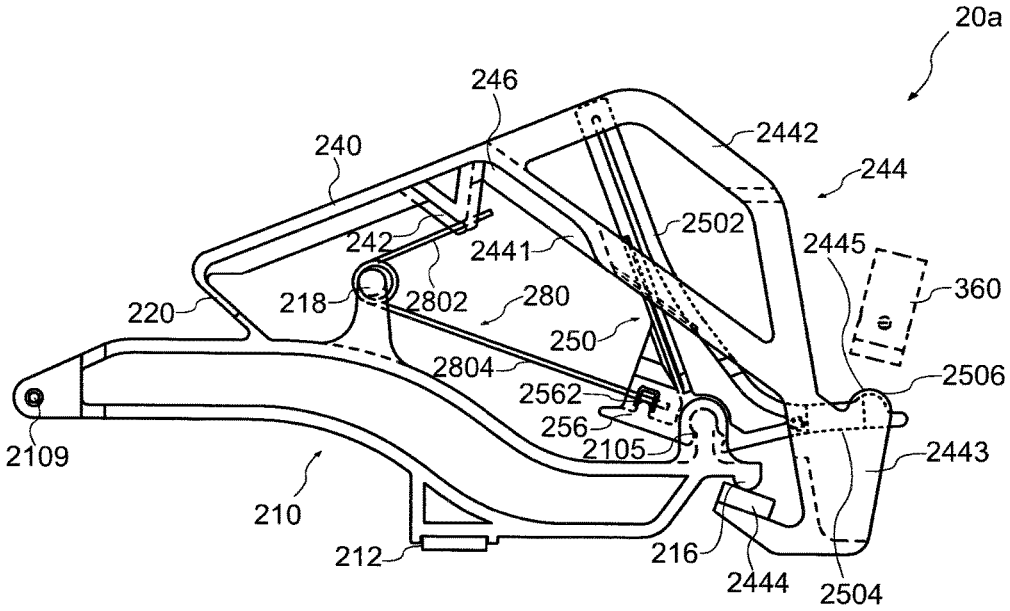
FIG. 2 is a side view showing the configuration of a support assembly in the first embodiment of the present invention.
Figure 3A:
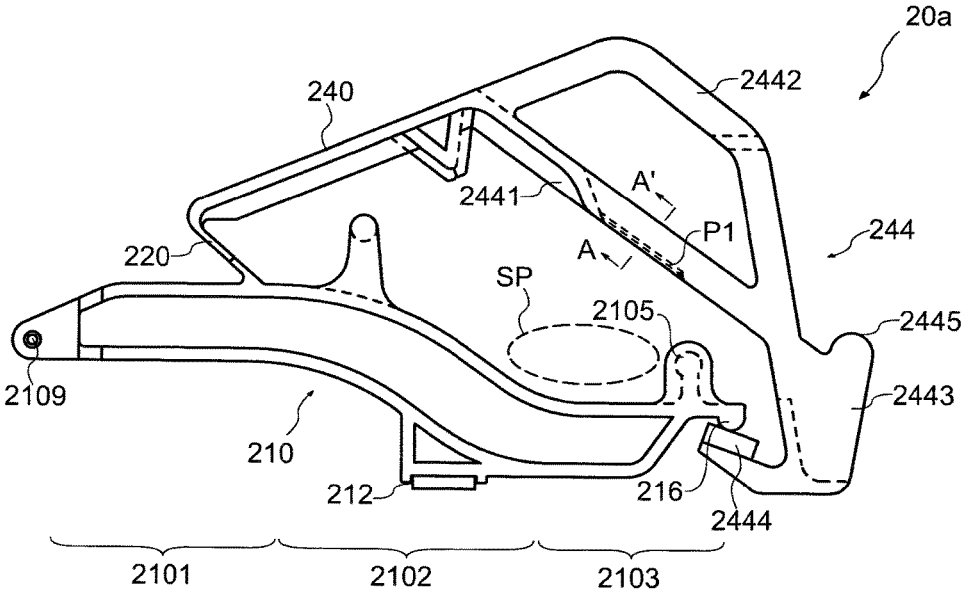
FIG. 3A is a side view showing a partial configuration of the disassembled support assembly in the first embodiment of the present invention.
Figure 3B:
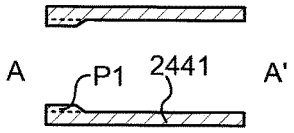
FIG. 3B is a side view showing a partial configuration of the disassembled support assembly in the first embodiment of the present invention.
Figure 3C:
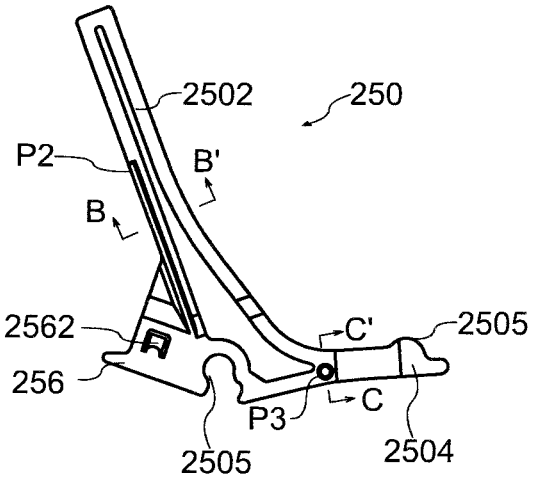
FIG. 3C is a side view showing a partial configuration of the disassembled support assembly in the first embodiment of the present invention.

FIG. 2 is a side view showing the configuration of the support assembly 20*a* in the first embodiment of the present invention. FIG. 3A to FIG. 3G are side views each showing a partial configuration of the disassembled support assembly in the first embodiment of the present invention. FIG. 3A is a diagram of the support assembly 20*a* with a jack 250 and a torsion coil spring 280 removed therefrom, for easy understanding of a feature of each component. FIG. 3C is a diagram only showing the jack 250.

The support assembly 20*a* includes a support 210, a repetition lever 240, the jack 250, and the torsion coil spring 280. The support 210 and the repetition lever 240 are coupled together via a flexible portion 220. The repetition lever 240 is rotatably supported by the flexible portion 220 with respect to the support 210.

Note that coupling between the support 210 and the repetition lever 240 is not limited to be made by a thin shape exemplarily shown as the flexible portion 220 but may be replaced by a rotatable member such as a hinge. As for the coupling between the support 210 and the repetition lever 240, for example, a repetition flange for use in a conventional support assembly may be used.

The support 210 and the repetition lever 240 may be a resin-made structure manufactured by injection molding or the like, except the torsion coil spring 280 and a rubber material provided at a portion colliding with another member. In this example, the support 210 and the repetition lever 240 are integrally formed. Note that the support 210 and the repetition lever 240 may be formed as individual components and these may be bonded or joined together.

The support 210 has one end side formed with a through hole 2109 and the other end side formed with a jack support portion 2105. Between the through hole 2109 and the jack support portion 2105, the support 210 includes a support heel 212 projecting lower side and a spring support portion 218 projecting upper side. A shaft supported by the support flange 290 is passed through the through hole 2109. This causes the support 210 to be rotatably disposed with respect to the support flange 290 and the support rail 920. The lower surface of the support heel 212 makes contact with the above-described capstan screw 120. The spring support portion 218 supports the torsion coil spring 280. The jack support portion 2105 rotatably supports the jack 250.

Between the through hole 2109 and the jack support portion 2105, a space SP is present on a jack support portion 2105 side with respect to the support heel 212. For convenience of description, the support 210 is sectioned, from a through hole 2109 side, into regions of a first main body portion 2101, a bent portion 2102, and a second main body portion 2103. In this case, by the bent portion 2102 coupling the first main body portion 2101 and the second main body portion 2103 together, the second main body portion 2103 is disposed on a side closer to the key 110 (lower side) compared with the first main body portion 2101. The jack support portion 2105 projects upper side from the second main body portion 2103. According to this sectioning, the above-described space SP corresponds to a region interposed between the bent portion 2102 and the jack support portion 2105 above the second main body portion 2103. Also, coupled to an end (an end on a second main body portion 2103 side) of the support 210 is a stopper 216.

A spring contact portion 242 and an extension portion 244 are coupled to the repetition lever 240. The spring contact portion 242 and the extension portion 244 extend from the repetition lever 240 to a support 210 side. The spring contact portion 242 makes contact with a first arm 2802 of the torsion coil spring 280. The repetition lever 240 and the extension portion 244 include two plate-shaped members interposing from sides of both side surfaces of the jack 250. In this example, the extension portion 244 and the jack 250 sliding contact with each other in at least a part of a space interposed by these two plate-shaped members.

The extension portion 244 includes an inner portion 2441, an outer portion 2442, a coupling portion 2443, and a stopper contact portion 2444. In the repetition lever 240, the inner portion 2441 is coupled to the side farther away from the player (flexible portion 220 side) with respect to a large jack 2502. A portion where the inner portion 2441 and the repetition lever 240 are coupled is provided with a rib 246. The inner portion 2441 crosses as interposing the large jack 2502 and extends to the side toward the front of the player (the side opposite to the flexible portion 220) with respect to the large jack 2502. That is, it can also be said that the extension portion 244 crosses the jack 250. The inner portion 2441 includes, in a portion interposing the large jack 2502, linearly-shaped protruding portions P1 projecting to a large jack 2502 side (refer to an A-A' section shown in FIG. 3B).

The outer portion 2442 is coupled to the side closer to the player (the side opposite to the flexible portion 220) than the jack 250 (large jack 2502) in the repetition lever 240. The inner portion 2441 and the outer portion 2442 are coupled together at the coupling portion 2443. The coupling portion 2443 interposes a small jack 2504. The stopper contact portion 2444 is coupled to the coupling portion 2443, and makes contact from below the stopper 216. According to this, the stopper 216 regulates a rotation range of the repetition lever 240 to a direction in which the repetition lever 240 and the support 210 spread (upper side). In other words, the extension portion 244 is connected to the repetition lever 240 on a jack 250 side from the rotation center of the repetition lever 240, and contacts with the stopper 216 from below the stopper 216. Here, the stopper 216 is connected to the support 210 below the rotation center of the jack 250.

The jack 250 includes the large jack 2502, the small jack 2504, and a projecting portion 256. Between the large jack 2502 and the small jack 2504, a support connecting portion 2505 for being rotatably supported by the jack support portion 2105 is formed. The support connecting portion 2505 has a shape surrounding a part of the jack support portion 2105, and regulates a rotation range of the jack 250. Also, the jack 250 can fit from above the jack support portion 2105 by the shape of the support connecting portion 2505 and elastic deformation of its material. The projecting portion 256 projects from the large jack 2502 to a side opposite to the small jack 2504, and rotates with the jack 250. The projecting portion 256 includes, on its side surface, a spring contact portion 2562. The spring contact portion 2562 contacts with a second arm 2804 of the torsion coil spring 280.

Figure 3D:
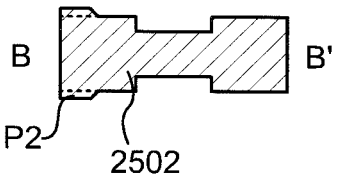
FIG. 3D is a side view showing a partial configuration of the disassembled support assembly in the first embodiment of the present invention.
Figure 3E:
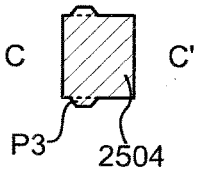
FIG. 3E is a side view showing a partial configuration of the disassembled support assembly in the first embodiment of the present invention.
Figure 3F:
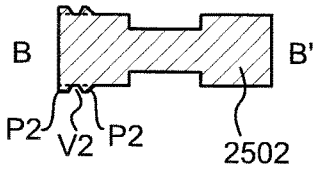
FIG. 3F is a side view showing a partial configuration of the disassembled support assembly in the first embodiment of the present invention.
Figure 3G:
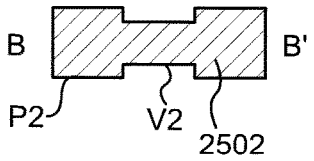
FIG. 3G is a side view showing a partial configuration of the disassembled support assembly in the first embodiment of the present invention.

The large jack 2502 includes linearly-shaped protruding portions P2 projecting from both side surfaces (refer to a B-B' section shown in FIG. 3D). The protruding portions P2 sliding contact with the protruding portions P1 of the inner portion 2441 described above. The small jack 2504 includes circular-shaped protruding portions P3 projecting from both side surfaces (refer to a C-C' section shown in FIG. 3E). The protruding portions P3 sliding contact with the inner surface of the coupling portion 2443 described above. In this manner, with the jack 250 and the extension portion 244 sliding contact with each other via the protruding portions P1, P2, and P3, a contact area is decreased. Note that as shown in FIG. 3F, a grease reservoir may be formed by forming a groove portion V2 by a plurality of protruding portions P2. Also, as shown in FIG. 3G, in a side surface shape, the large jack 2502 may have the protruding portions P2 or the groove portions V2.

With the protruding portions P1 of the inner portion 2441 and the protruding portions P2 of the large jack 2502 sliding contact with each other, the extension portion 2442 and the large jack 2502 mutually interfere with each other to inhibit a lateral swing of the repetition lever 240. Here, with the protruding portions P1 and the protruding portions P2 each have a linearly-extending shape to sliding contact in the rotation range of the repetition lever 240 and the jack 250, the operation of the support assembly 20 is stabilized.

With the torsion coil spring 280 taking the spring support portion 218 as a supporting point, the first arm 2802 contacts with the spring contact portion 242, and the second arm 2804 contacts with the spring contact portion 2562. The first arm 2802 functions as an elastic body which provides a rotating force to the repetition lever 240 via the spring contact portion 242 so as to move the player's side of the repetition lever 240 upper side (a direction away from the support 210). The second arm 2804 functions as an elastic body which provides a rotating force to the jack 250 via the spring contact portion 2562 so as to move the projecting portion 256 lower side (a direction closer to the support 210).

The extension portion 244 coupled to the repetition lever 240 includes a first contact portion 2445. The first contact portion 2445 is disposed on the coupling portion 2443, and is provided at a position making contact with the regulating portion 360 when the repetition lever 240 rotates. The operation range of rotation of the repetition lever 240 with key depressing is regulated by providing the first contact portion 2445 at one end of the extension portion 244.

The jack 250 includes a second contact portion 2506. The second contact portion 2506 is disposed on the small jack 2504, and is provided at a position making contact with the regulating portion 360 when the jack 250 rotates. The second contact portion 2506 supports operation of an upper portion of the jack 250 coming off from the hammer roller 315 when the hammer is hit up.

In the present embodiment, the small jack 2504 is interposed by the coupling portion 2443 from both sides. Note that while the structure in which the coupling portion 2443 interposes the small jack 2504 is exemplarily described in the present embodiment, the present invention is not limited to this structure. In a relation between the extension portion 244 and the jack 250, a structure may be such that the jack 250 interposes the extension portion 244. That is, a structure may be such that the small jack 2504 interposes the coupling portion 2443. In this manner, the structure in which one member interposes the other member can provide the first contact portion 2445 and the second contact portion 2506 as overlapping each other.

The first contact portion 2445 and the second contact portion 2506 both make contact with the same regulating portion 360. That is, while at least two contact surfaces of a regulating screw and a regulating button are required in a conventional action mechanism, aggregation into one can be made in the present embodiment. In this case, the first contact portion 2445 and the second contact portion 2506 preferably make contact with the same surface of the regulating portion 360. This can reduce the size of the contact surface of the regulating portion 360. Note that locations the first contact portion 2445 and the second contact portion 2506 make contact with are not limited to the same location in the same surface of the regulating portion 360, but may be shifted from each other. The locations that the first contact portion 2445 and the second contact portion 2506 make contact with are not limited to one plane of the same surface of the regulating portion 360, but may have a shape including a step or the like.

Also, a surface of the regulating portion 360 making contact with the first contact portion 2445 and the second contact portion 2506 is preferably a flat surface. This simplifies the structure of the regulating portion 360 and facilitates positional adjustment of the contact surface. Also as another embodiment, the contact surface of the regulating portion 360 may have a shape including a step portion, a curved shape, a tilted surface shape, or the like, in accordance with the positions of the first contact portion 2445 and the second contact portion 2506 and their modes. By making the contact surface of the regulating portion 360 appropriate in accordance with the positions where the first contact portion 2445 and the second contact portion 2506 are disposed in the support assembly and modes, design flexibility can be provided to the support assembly. At any rate, as for the aspect of the regulating portion 360 is only required to allow simultaneous adjustment of the positions the first contact portion 2445 and the second contact portion 2506 make contact with. Modes of the regulating portion 360 as described above are exemplarily described also in a fourth embodiment and a fifth embodiment.

Figure 4A:
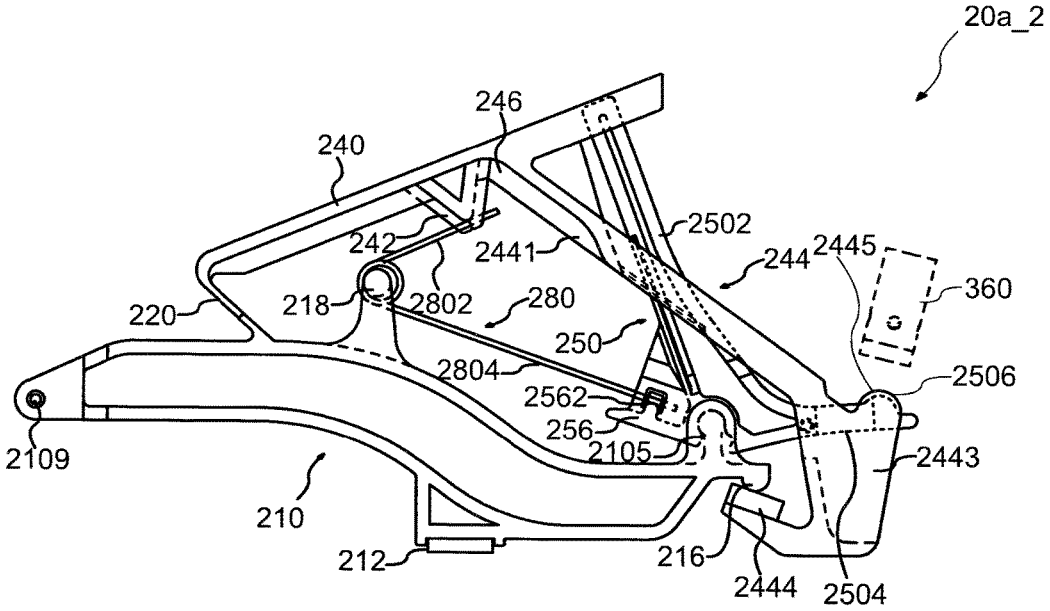
FIG. 4A is a side view showing the configuration of the support assembly in the first embodiment of the present invention.

In the present embodiment, the structure of the support assembly is not limited to the one shown in FIG. 2. For example, as in a support assembly 20*a*_2 shown in FIG. 4A, the outer portion may be omitted in the extension portion 244 of the repetition lever 240. As the extension portion 244, it is only required that the coupling portion 2443 is coupled to one end of the inner portion 2441 and the first contact portion 2445 is included in that coupling portion. Also in this structure, the first contact portion 2445 in the coupling portion 2443 and the second contact portion 2506 of the small jack 2504 are provided so as to overlap each other, thereby achieving operations and effects similar to those of the support assembly 20*a* shown in FIG. 2.

Figure 4B:
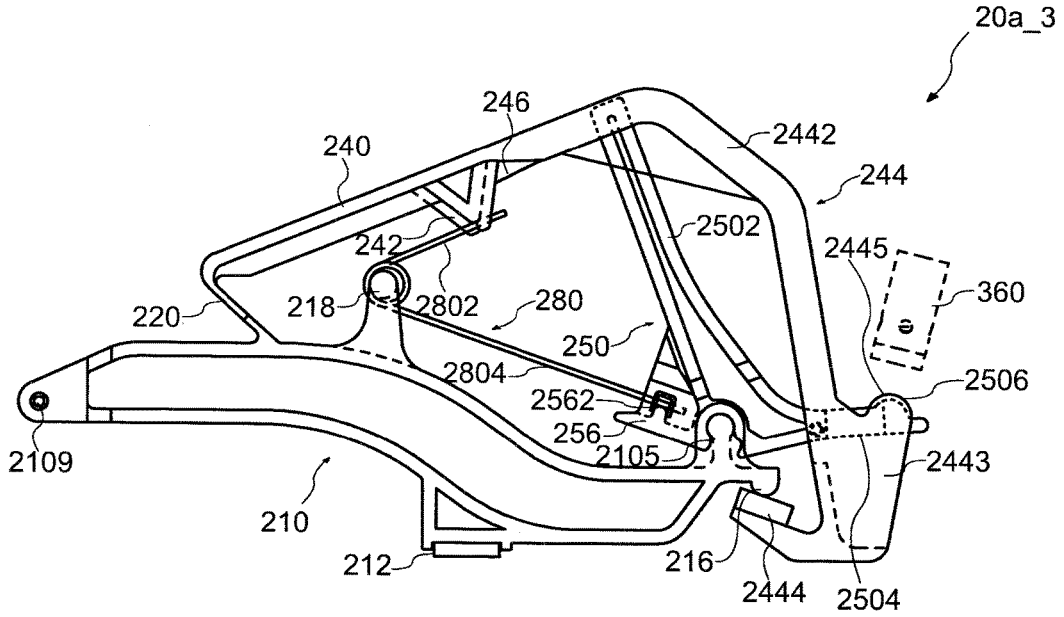
FIG. 4B is a side view showing the configuration of the support assembly in the first embodiment of the present invention.

Also, as in a support assembly 20*a*_3 shown in FIG. 4B, the inner portion may be omitted in the extension portion 244 of the repetition lever 240. As the extension portion 244, if the coupling portion 2443 is coupled to one end of the outer portion 2442 and the first contact portion 2445 is included in that coupling portion, the first contact portion 2445 in the coupling portion 2443 and the second contact portion 2506 of the small jack 2504 can be provided so as to overlap each other, thereby achieving operations and effects similar to those of the support assembly 20*a* shown in FIG. 2.

Operation of Support Assembly 20*a*

Described next is an operation of the support assembly 20*a* when the state the key 110 in a state of being at the rest position (FIG. 1) is depressed to the end position.

Figure 5:
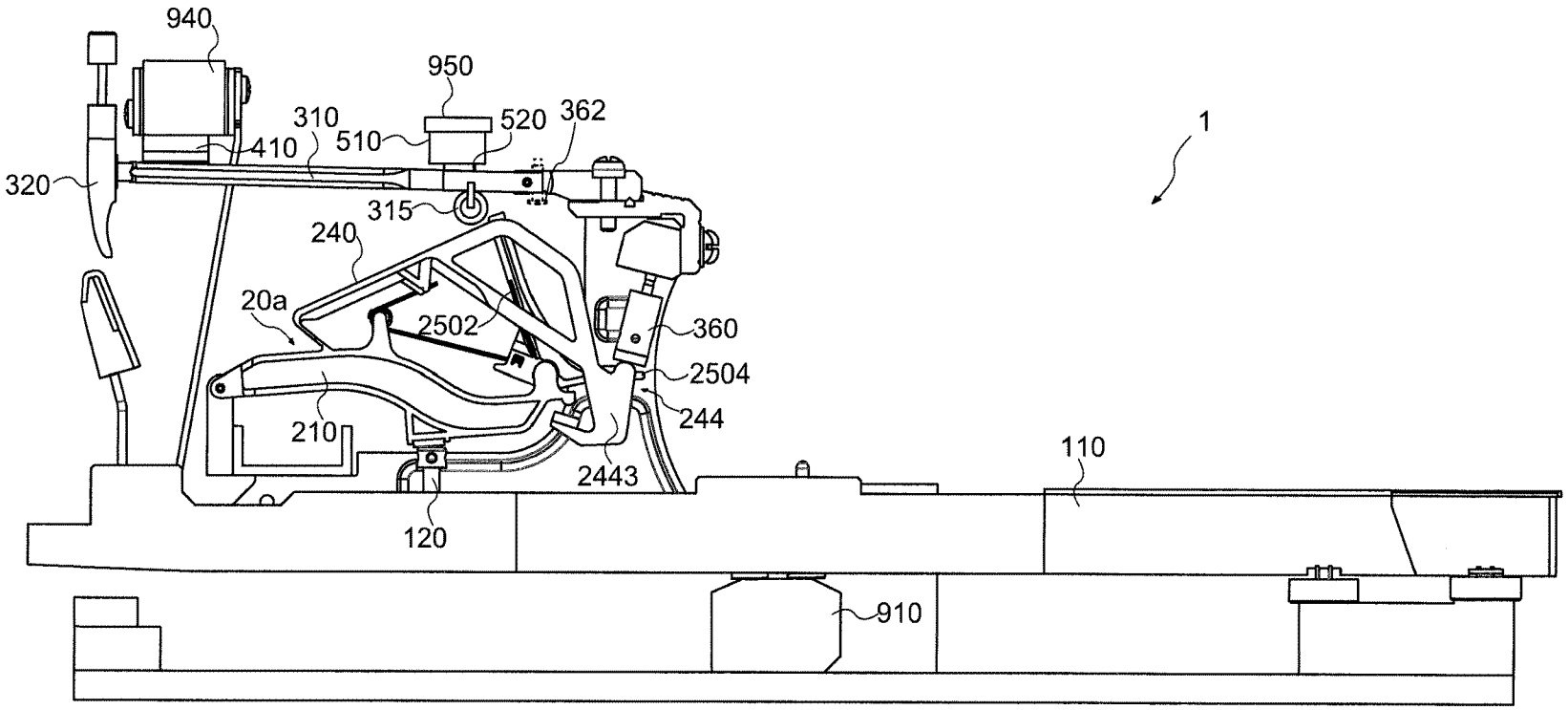
FIG. 5 is a side view for describing a motion of the support assembly in the first embodiment of the present invention.

FIG. 5 is a side view for describing the operation of the support assembly in the first embodiment of the present invention. When the key 110 is depressed to the end position, the capstan screw 120 presses up the support heel 212 to rotate the support 210 with the axis of the through hole 2109 taken as a rotation center. When the support 210 rotates to move upper side, the large jack 2502 presses up the hammer roller 315 to cause the hammer shank 310 to collide with the hammer stopper 410. Note that in the case of a general grand piano, this collision corresponds to string hitting by the hammer.

Figure 6A:
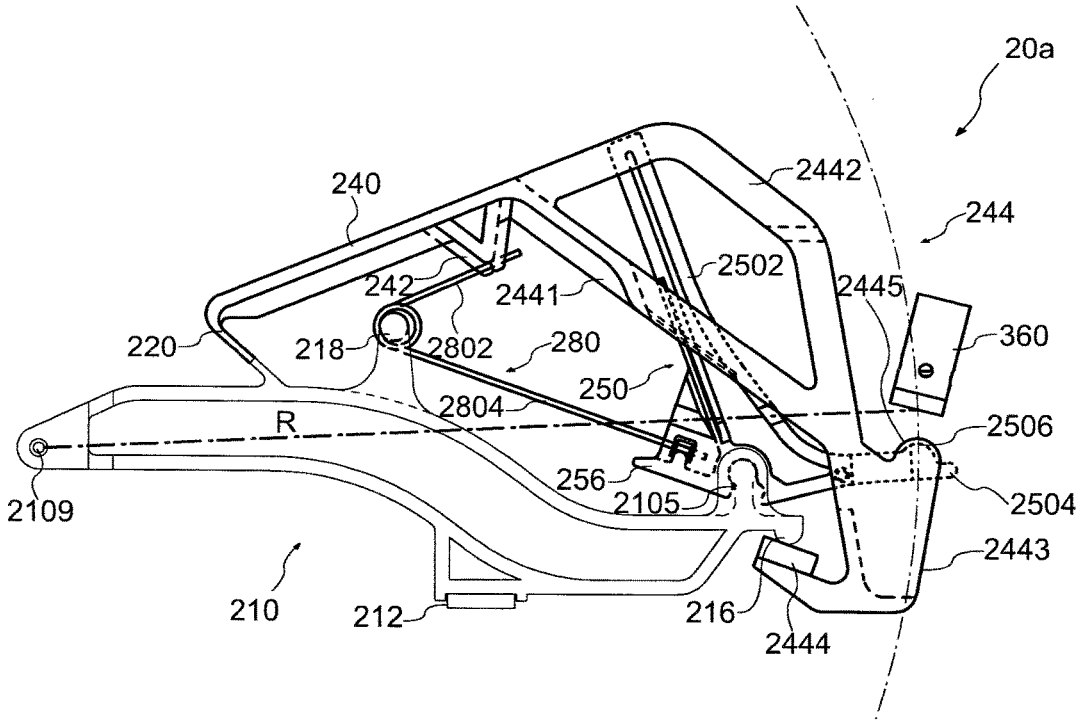
FIG. 6A is a side view for describing a motion of the support assembly in the first embodiment of the present invention, showing a state before a key is depressed.
Figure 6B:
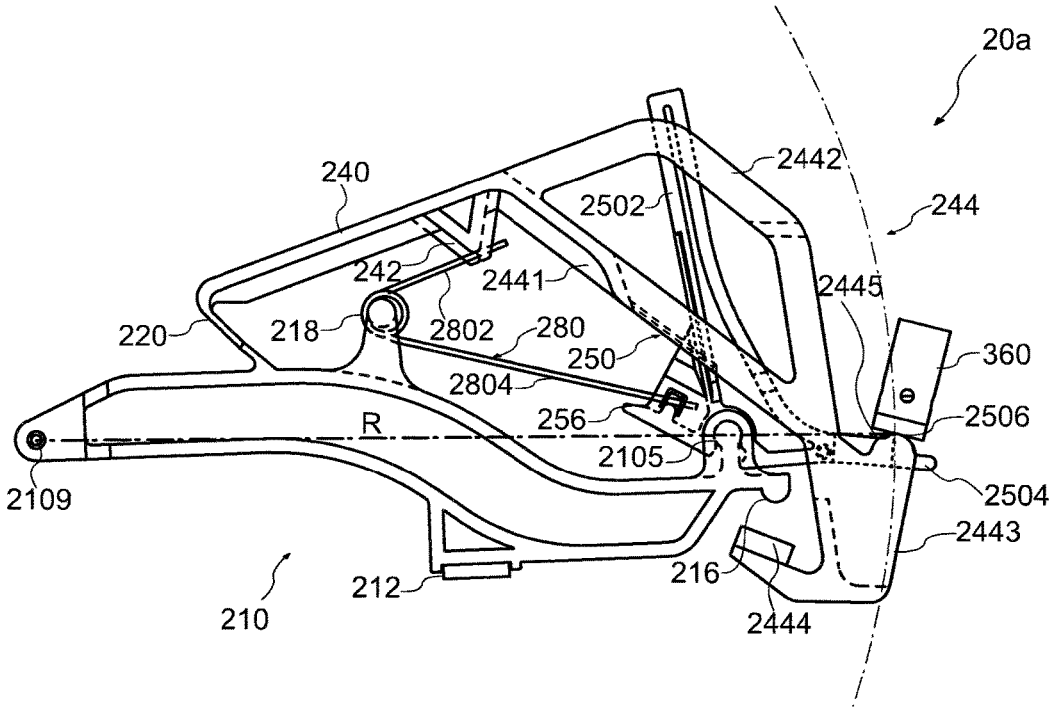
FIG. 6B is a side view for describing a motion of the support assembly in the first embodiment of the present invention, showing a state when a key is depressed.

The operation of the support assembly 20*a* at this time is shown in FIG. 6A and FIG. 6B. FIG. 6A shows a state of the support 210, the repetition lever 240, and the jack 250 in the state before the key is depressed (rest state). In this state, the stopper contact portion 2444 in the extension portion 244 of the repetition lever 240 comes in contact with the stopper 216 of the support 210 and is retained. Here, the first contact portion 2445 of the coupling portion 2443 and the second contact portion 2506 of the small jack 2504 are away from the regulating portion 360.

FIG. 6B shows a state when the key is depressed (operation state). The support 210 rotates, and a front side portion moves upper side. Immediately before the hammer shank 310 collides with the hammer stopper 410, the second contact portion 2506 of the small jack 2504 contacts with the regulating portion 360 to regulate upper side rotation and further cause the support 210 (jack support portion 2105) to ascend. Thus, the large jack 2502 rotates so as to come off from the hammer roller 315. The repetition lever 240 rotates together with the support 210, and the first contact portion 2445 in the coupling portion 2443 contacts with the regulating portion 360 at the same timing as the second contact portion 2506. As a result, the repetition lever 240 is regulated from upper side rotation and is displaced so as to approach the support 210. That is, these operations achieve a double escapement mechanism. FIG. 5 is a diagram showing this state. Note that when the key 230 is being returned to the rest position, the hammer roller 315 is supported by the repetition lever 240, and the large jack 2502 is returned below the hammer roller 315.

FIG. 6A and FIG. 6B show an aspect in which the first contact portion 2445 and the second contact portion 2506 are disposed on the circumference of a circle by taking the through hole 2109 of the support 210 as a rotation center and taking a straight-line R (a straight-line R indicated by a one-dot-chain line in the drawing) connecting the rotation center and the regulating portion 360 as a radius. When the support assembly 20*a* rotates, the first contact portion 2445 and the second contact portion 2506 move along the circumference of the circle with this straight-line R taken as a radius. In this manner, with the first contact portion 2445 and the second contact portion 2506 configured to move on the same circumference, the regulating portion 360 can be aggregated to one location. This can simplify the structure of the support assembly 20*a*.

The support assembly according to the present embodiment has a configuration in which the first contact portion 2445 for controlling rotation of the repetition lever 240 and the second contact portion 2506 for controlling rotation of the jack 250 both make contact with the regulating portion 360. By adjusting the position of the regulation portion 360, both of the repetition lever 240 and the jack 250 can regulate the operation range at the time of key depressing. That is, since the operations of two components, that is, the repetition lever 240 and the jack 250, can be adjusted at one location of the regulating portion 360, operation stability can be enhanced while the structure of the support assembly is simplified. Also, since the regulating portion 360 which regulates rotation of two members, that is, the repetition lever 240 and the jack 250, is aggregated to one, adjustment of positional alignment is simplified and facilitated.

Also, with the jack 250 and the extension portion 244 sliding contact with each other, the jack 250 functions also as a guide portion for the repetition lever 240 (and the extension portion 244). Thus, even if yawing (lateral deviation) and rolling (twisting) of the repetition lever 240 tend to occur due to connection of the repetition lever 240 to the flexible portion 220, the occurrence of these phenomena can be inhibited. That is, it is possible to easily achieve rotation of the repetition lever 240 along a plane on which the jack 250 rotates. Also, with the jack 250 configured to rotate along a plane on which the support 210 rotates, it is also possible to easily achieve rotation of the repetition lever 240 along the plane on which the support 210 rotates.

Sound Generating Mechanism of Keyboard Apparatus 1

As described above, the keyboard apparatus 1 is an example of application to an electronic piano. An operation on the key 110 is measured by a sensor 510, and a sound in accordance with the measurement result is outputted.

Figure 7:
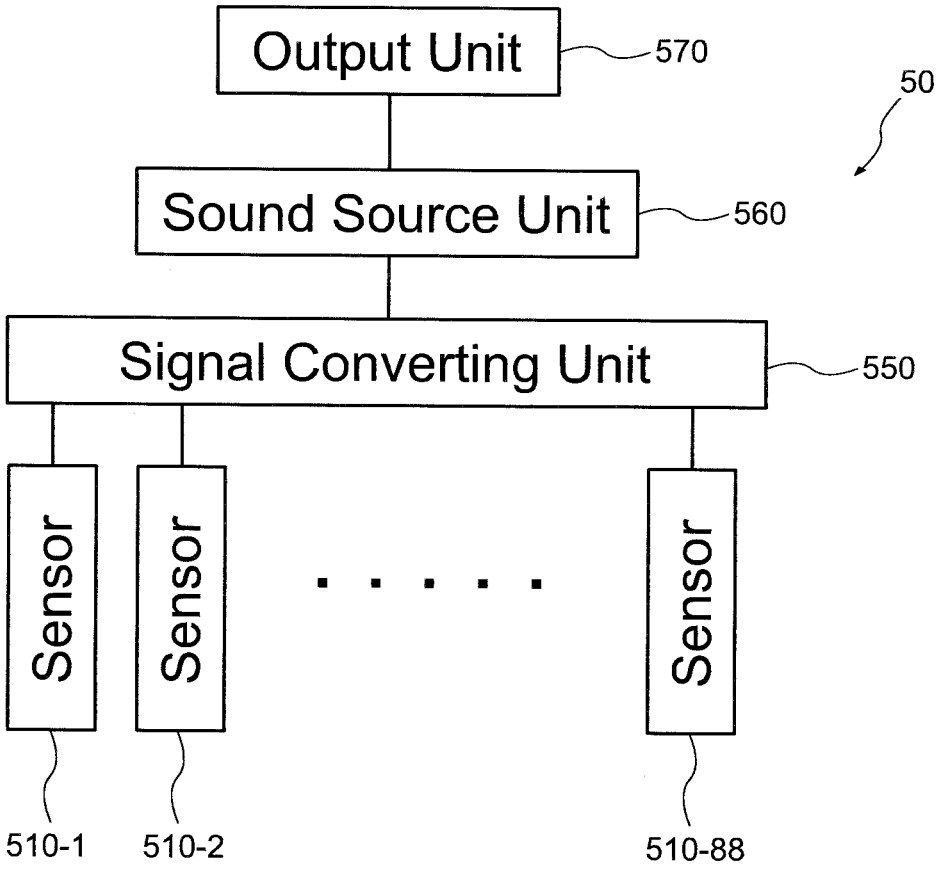
FIG. 7 is a block diagram showing the configuration of a sound generation mechanism of the keyboard apparatus in the first embodiment of the present invention.

FIG. 7 is a block diagram showing the configuration of a sound generating mechanism of the keyboard apparatus in the first embodiment of the present invention.

A sound generation mechanism 50 of the keyboard apparatus 1 includes the sensor 510 (sensors 510-1, 510-2, . . . 510-88 corresponding to the eighty-eight keys 110), a signal converting unit 550, a sound source unit 560, and an output unit 570. The signal converting unit 550 obtains an electrical signal outputted from the sensor 510, and generates and outputs an operation signal in accordance with the operation state in each key 110. In this example, the operation signal is a signal in MIDI format. Thus, in accordance with the timing when the hammer shank 310 collides with the hammer stopper 410 by a key-depressing operation, the signal converting unit 550 outputs note-ON. Here, a key number indicating which of the 88 keys 110 has been operated and a velocity corresponding to the speed immediately before collision are also outputted in association with the note-ON. On the other hand, when a key-releasing operation is performed, in accordance with the timing when string vibrations are stopped by a damper in the case of a ground piano, the signal converting unit 550 outputs the key number and note-OFF in association with each other. To the signal converting unit 550, a signal in accordance with another operation such as that of a pedal may be inputted and reflected onto the operation signal. The sound source unit 560 generates a sound signal based on the operation signal outputted from the signal converting unit 550. The output unit 570 is a loudspeaker or terminal which outputs the sound signal generated by the sound source unit 560.

Second Embodiment

Figure 8:
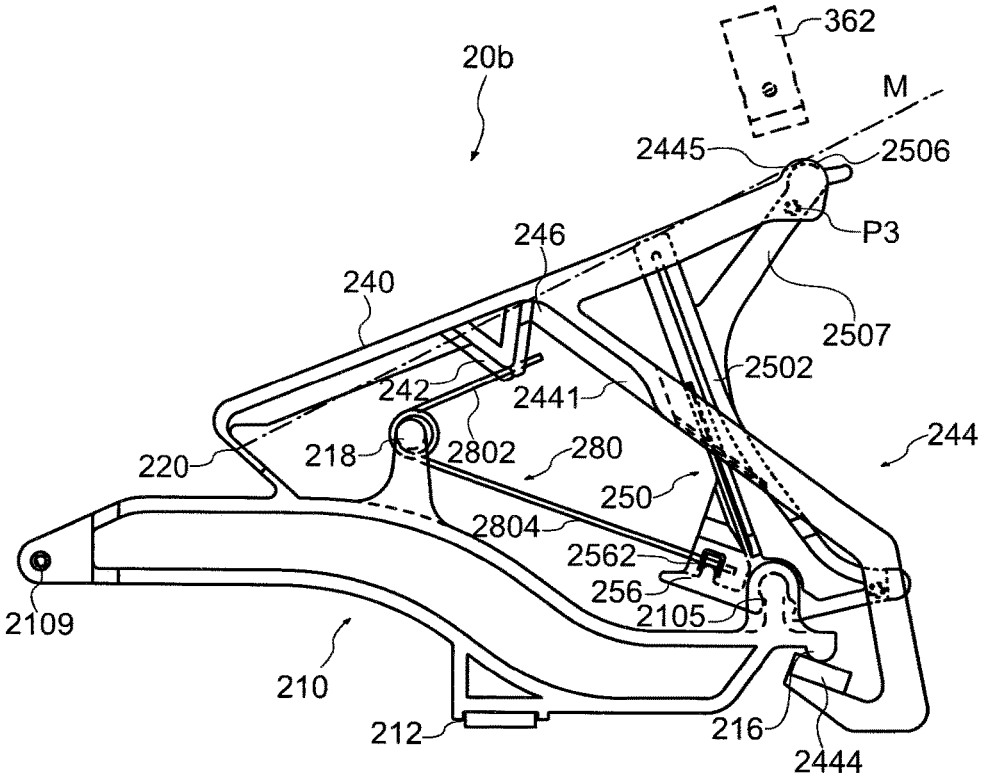
FIG. 8 is a side view showing the configuration of a support assembly in a second embodiment of the present invention.

FIG. 8 is a side view showing the configuration of a support assembly 20*b* in a second embodiment of the present invention. In the following, portions different from those in the first embodiment are described.

The jack 250 includes the large jack 2502 and a jack extension portion 2507 extended from the large jack 2507. In the present embodiment, the jack extension portion 2507 is branched from the large jack 2502 toward the repetition lever 240. An end of the jack extension portion 2502 includes the second contact portion 2506.

The extension portion 244 is coupled to the repetition lever 240. The extension portion 244 is provided so as to be branched lower side from the repetition lever 240. One end of the extension portion 244 is coupled to the stopper contact portion 2444. On the other hand, the repetition lever 240 includes the first contact portion 2445 making contact with a second regulating portion 362. The second regulating portion 362 is also called a repetition regulating screw, and is provided to the jack flange 390 as shown in FIG. 1. With the first contact portion 2445 making contact with the second regulating portion 362, rotation of the repetition lever 240 is regulated. The jack extension portion 2507 provided to the large jack 2502 is provided so that the second contact portion 2506 makes contact with the second regulating portion 362. That is, in the support assembly 20*b* in the present embodiment, the first contact portion 2445 of the repetition lever 240 and the second contact portion 2506 in the jack 250 are disposed so as to both make contact with the second regulating portion 362.

With the rotation of the support 210, the repetition lever 240 rotates by taking the flexible portion 220 as a center. FIG. 8 shows one example in which the second contact portion 2506 is disposed on a straight line M (a straight line M indicated by a one-dot-chain line in the drawing) connecting this rotation center of the repetition lever 240 and a portion at which the large jack 2502 crosses the repetition lever 240. In the repetition lever 240, the first contact portion 2445 is disposed so as to overlap this straight line M. With such the arrangement, the first contact portion 2445 and the second contact portion 2506 can be brought make contact with the second regulating portion 362 with the rotation of the repetition lever 240. Thereby, it is possible to simplify the structure of the support assembly 20*a*.

In the present embodiment, the first contact portion 2445 of the repetition lever 240 may interpose the second contact portion 2506 of the jack extension portion 2507 and the first contact portion 2445 and the second contact portion 2506 may be disposed so as to overlap each other. Also, as its reversed structure, the jack extension portion 2507 may be disposed so as to interpose the first contact portion 2445 of the repetition lever 240 at a portion including the second contact portion 2506.

Note that the first contact portion 2445 and the second contact portion 2506 are not limited to the structure shown in FIG. 8 in the present embodiment. The structure of the first contact portion 2445 and the second contact portion 2506 may be any as long as they can make contact with the same second regulating portion 362. For example, the first contact portion 2445 and the second contact portion 2506 may be deviated in a front-and-back direction or a vertical direction. In other words, the structure may be any as long as the contact position between the first contact portion 2445 and the second contact portion 2506 is controlled by adjusting the position of the second regulating portion 362 to allow the rotation of the repetition lever 240 and the jack 250 to be regulated.

In the present embodiment, the jack extension portion 2507 may be provided with the circular-shaped protruding portions P3 projecting from both side surfaces. The protruding portions P3 are similar to those shown in FIG. 3F in the first embodiment. The protruding portions P3 sliding contact with the inner surface of the repetition lever 240. Also in the present embodiment, in addition to the protruding portions P1 and P2, the jack extension portion 2507 has the protruding portions P3, thereby decreasing the contact area sliding contact with the inner surface of the repetition lever 240. A recessed groove may be provided at the tip of each protruding portion P3 to provide a grease reservoir. With the protruding portions P3 provided to the small jack 2504 interposed in contact with the inner surface of the repetition lever 240, a lateral swing of the repetition lever 240 can be inhibited.

According to the present embodiment, while at least two members, that is, a regulating clew and a regulating button, are conventionally required, aggregation into one can be made. Also in the aspect of the support assembly shown in the present embodiment, with the first contact portion and the second contact portion making contact with the second regulating portion, effects similar to those of the first embodiment can be achieved.

Third Embodiment

Figure 9:
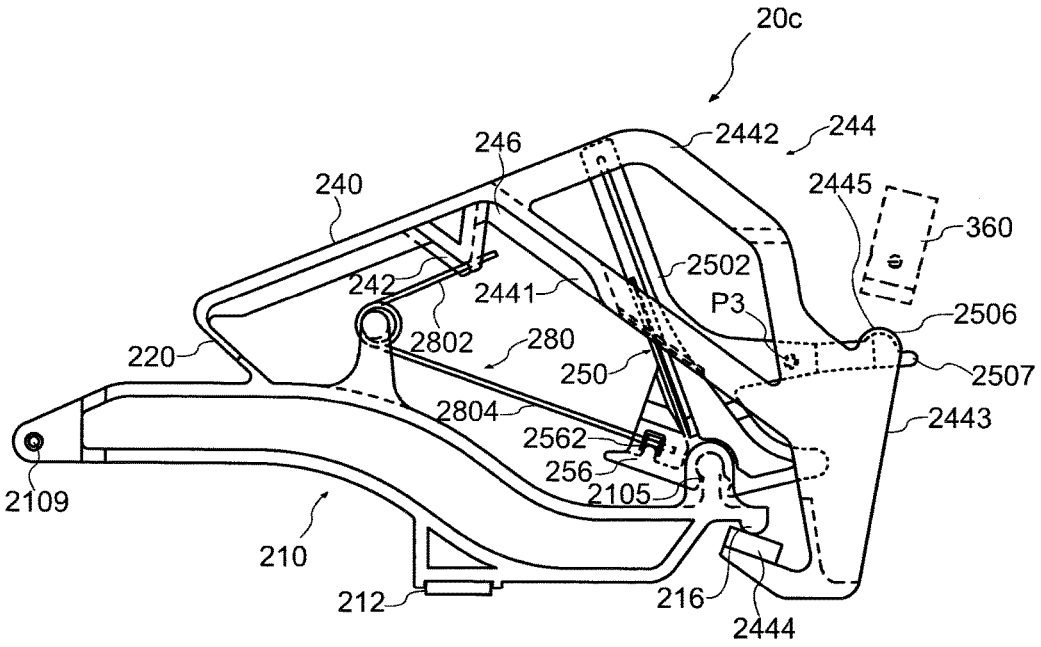
FIG. 9 is a side view showing the configuration of a support assembly in a third embodiment of the present invention.

FIG. 9 is a side view showing the configuration of a support assembly 20*c* in a third embodiment of the present invention. In the following, portions different from those in the first embodiment are described.

In the present embodiment, the jack 250 has the large jack 2502 and the jack extension portion 2507. The jack extension portion 2507 extends in a direction crossing a longitudinal direction of the large jack 2502, and includes the second contact portion 2506 in a tip region. In the jack extension portion 2507, the second contact portion 2506 is provided at a position making contact with the regulating portion 360 when the jack 250 rotates.

The repetition lever 240 is coupled to the extension portion 244. The extension portion 244 includes the inner portion 2441, the outer portion 2442, the coupling portion 2443, and the stopper contact portion 2444. The extension portion 244 coupled to the repetition lever 240 includes the first contact portion 2445. The first contact portion 2445 is disposed on the coupling portion 2443, and is provided at a position making contact with the regulating portion 360 when the repetition lever 240 rotates.

The first contact portion 2445 provided to the extension portion 244 of the repetition lever 240 and the second contact portion 2506 in the jack extension portion 2507 may be provided so that at least partial regions overlap each other. This allows the first contact portion 2445 and the second contact portion 2506 to make contact with the same contact surface of the regulating portion 360. Note that while the mode is shown in FIG. 9 in which the first contact portion 2445 is disposed on the coupling portion 2443, the present invention is not limited to this. The first contact portion 2445 can be attached to any position of the extension portion 244 as long as the position can make contact with the regulating portion 360 and, for example, may be disposed on a part of the outer portion 2442.

Note that also in the present embodiment, as described in FIG. 3F, the jack extension portion 2507 may include circular-shaped protruding portions P3 projecting from both side surfaces. With the jack extension portion 2507 provided with the protruding portions P3 to sliding slide the inner surface of the coupling portion 2443, the contact area is decreased, and a lateral swing of the repetition lever 240 can also be inhibited.

Also in the present embodiment, with the first contact portion 2445 and the second contact portion 2506 provided as overlapping each other, both make contact with the same regulating portion 360. Thus, although at least two members of a regulating clew and a regulating button are conventionally required, they can be integrated into one member, and the similar effect as the first embodiment is exerted in the present embodiment.

Fourth Embodiment

Figure 10:
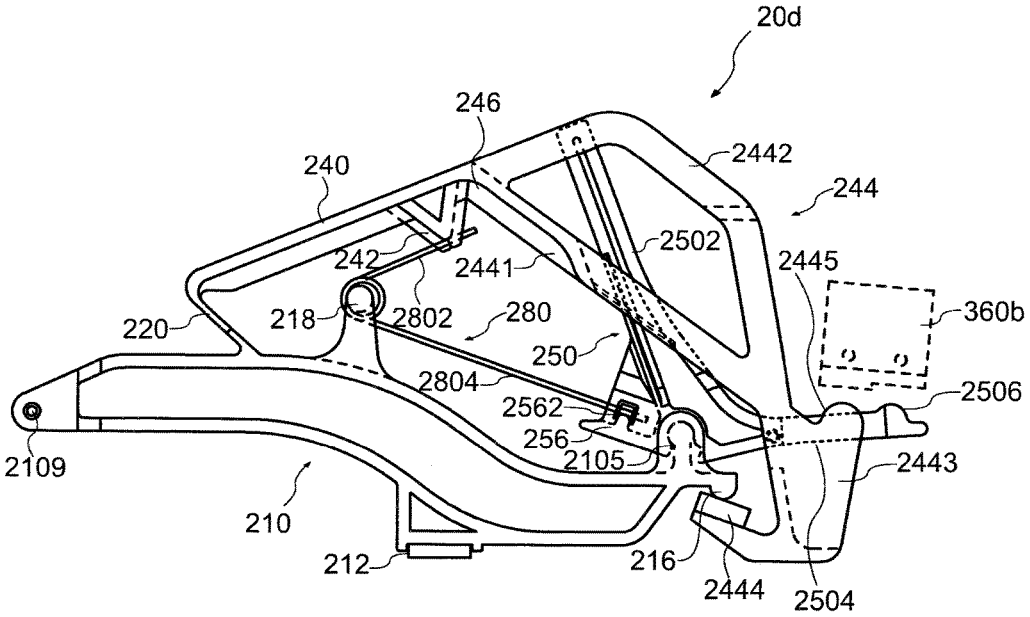
FIG. 10 is a side view showing the configuration of a support assembly in a fourth embodiment of the present invention.

FIG. 10 is a side view showing the configuration of a support assembly 20*d* in the third embodiment of the present invention. In the following, portions different from those in the first embodiment are described.

The repetition lever 240 includes the extension portion 244. Placed on its coupling portion 2443 is the first contact portion 2445. The jack 250 includes the large jack 2502 and the small jack 2504, and the second contact portion 2506 is disposed on the small jack 2504. The tip of the small jack 2504 extends outside the coupling portion 2443. The second contact portion 2506 is disposed at one end of the small jack 2504 going off outside from the coupling portion 2443. That is, the first contact portion 2445 and the second contact portion 2506 are disposed so as to be away from each other.

By contrast, a regulating portion 360*b* has a mode capable of making contact with both of the first contact portion 2445 and the second contact portion 2506, and is disposed at a predetermined position. For example, the regulating portion 360*b* has a contact surface with a wide width so as to allow both the first contact portion 2445 and the second contact portion 2506 disposed as being away from each other to make contact with each other.

The operation of the support assembly 20*d* is similar to that described in the first embodiment. Even if the first contact portion 2445 in the repetition lever 240 and the second contact portion 2506 in the jack 250 are disposed as being deviated in a front-and-back direction (when viewed from the player), the structure is made such that both contact portions make contact with the same regulating portion 360*b*. Thus, as with the first embodiment, while the structure of the support assembly is simplified, operation stability can be enhanced. That is, only by adjusting one location of the regulating portion 360*b*, positional alignment of two contact portions can be made, thereby allowing adjustment to be simplified and facilitated. Also, the regulating portion 360*b* which regulates the rotation of the two members, that is, the repetition lever 240 and the jack 250, is aggregated into one, thereby simplifying and facilitating adjustment of positional alignment.

Note that a contact surface of the regulating portion 360*b* making contact with the first contact portion 2445 and the second contact portion 2506 is not limited to a flat surface. For example, in accordance with the first contact portion 2445 and the second contact portion 2506, the contact portion of the regulating portion 360*b* may include a step portion. As another mode, the contact surface may be tilted in a tapered shape. By changing the mode of the contact surface of the regulating portion 360*b*, flexibility can be provided to the placement of the first contact portion 2445 in the repetition lever 240 and the second contact portion 2506 in the jack 250. Also, a front-and-back relation between the first contact portion 2445 and the second contact portion 2506 may have a relation opposite to the one shown in FIG. 10.

Fifth Embodiment

Figure 11:
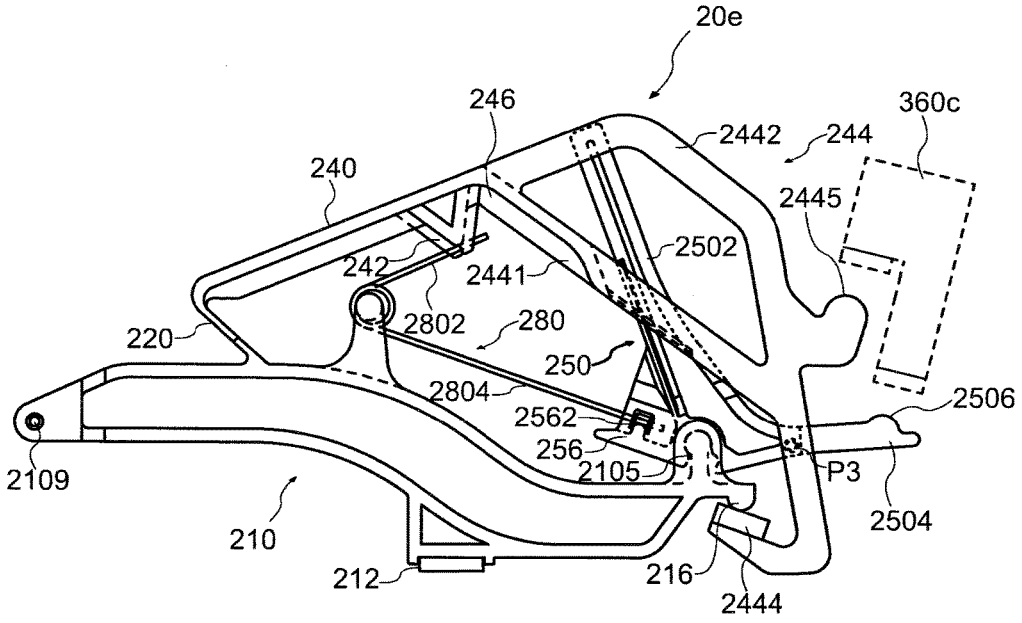
FIG. 11 is a side view showing the configuration of a support assembly in a fifth embodiment of the present invention.

FIG. 11 is a side view showing the configuration of a support assembly 20*e* in the third embodiment of the present invention. In the following, portions different from those in the first embodiment are described.

The repetition lever 240 includes the extension portion 244, the first contact portion 2445 is disposed on the outer portion 2442. The jack 250 includes the large jack 2502 and the small jack 2504, and the second contact portion 2506 is disposed on the small jack 2504. In FIG. 11, the first contact portion 2445 is provided above the second contact portion 2506. Note that FIG. 11 shows an example, and a vertical relation between the first contact portion 2445 and the second contact portion 2506 may be reversed.

By contrast, a regulating portion 360*c* has a mode capable of making contact with both of the first contact portion 2445 and the second contact portion 2506, and is disposed at a predetermined position. For example, the regulating portion 360*c* has a plurality of contact surfaces so as to allow contacts of both of the first contact portion 2445 and the second contact portion 2506 disposed vertically away from each other. In this case, the regulating portion 360*c* is preferably in a mode in which the plurality of contact surfaces are integrated and can be regarded as substantially single member. In other words, in the regulating portion 360*c*, the contact surface making contact with the first contact portion 2445 and the contact surface making contact with the second contact portion 2506 are preferably integrated so as to be allowed to be both simultaneously aligned in position even if they are provided via a step.

The operation of the support assembly 20*d* is similar to that described in the first embodiment. With the structure in which the first contact portion 2445 and the second contact portion 2506 both make contact with the same regulating portion 360*c*, as with the first embodiment, operation stability can be enhanced, while the structure of the support assembly is simplified. That is, only by adjusting one location of the regulating portion 360*c*, positional alignment of two contact portions can be made, thereby allowing adjustment to be simplified and facilitated. Also, the regulating portion 360 which regulates the rotation of two members, that is, the repetition lever 240 and the jack 250, is aggregated to one, thereby simplifying and facilitating adjustment of placement alignment.

In the foregoing, as has been described by exemplarily showing the first embodiment to the fifth embodiment, according to one embodiment of the present invention, with the structure in which the contact portion of the repetition lever and the contact portion of the jack make contact with the same regulating portion, the structure of the support assembly can be simplified, and operation stability can be enhanced. Also, with this structure, the number of components of the support assembly can be decreased, and a reduction in manufacturing cost can be made.

INDUSTRIAL APPLICABILITY

In the above-described embodiments, an electronic piano is described as an example of the keyboard apparatus to which the support assembly is applied. However, the present invention is not limited to this, and the support assembly disclosed in the above embodiments can be applied also to a grand piano (acoustic piano) and a keyboard apparatus with its action mechanism similar to that thereof.

REFERENCE SIGNS LIST

1 . . . keyboard apparatus, 20 . . . support assembly, 50 . . . sound generation mechanism, 110 . . . key, 120 . . . capstan screw, 210 . . . support, 2101 . . . first main body portion, 2102 . . . bent portion, 2013 . . . second main body portion, 2105 . . . jack support portion, 2109 . . . through hole, 212 . . . support heel, 216 . . . stopper, 218 . . . spring support portion, 220 . . . flexible portion, 240 . . . repetition lever, 242 . . . spring contact portion, 244 . . . extension portion, 2441 . . . inner portion, 2442 . . . outer portion, 2443 . . . coupling portion, 2444 . . . stopper contact portion, 2445 . . . first contact portion, 246 . . . rib, 250 . . . jack, 2502 . . . large jack, 2504 . . . small jack, 2505 . . . support connecting portion, 2506 . . . second contact portion, 2507 . . . jack extension portion, 256 . . . projecting portion, 2562 . . . spring contact portion, 280 . . . torsion coil spring, 2802 . . . first arm, 2804 . . . second arm, 290 . . . support flange, 310 . . . hammer shank, 315 . . . hammer roller, 320 . . . hammer, 360 . . . regulating portion, 362 . . . second regulating portion, 390 . . . shank flange, 410 . . . hammer stopper, 510 . . . sensor, 520 . . . shielding plate, 550 . . . signal converting unit, 560 . . . sound source unit, 570 . . . output unit, 900 . . . bracket, 910 . . . balance rail, 920 . . . support rail, 930 . . . shank rail, 940 . . . hammer stopper rail, 950 . . . sensor rail

What is claimed is:

1. A support assembly comprising:

a support rotatable along a first surface with respect to a frame;

a repetition lever rotatable on the support; and a jack rotatable on the support, the repetition lever including a first contact portion which regulates a rotating operation of the repetition lever, the jack including a second contact portion which regulates a rotating operation of the jack, and the first contact portion and the second contact portion making contact with a common regulating portion to regulate the rotating operations of the repetition lever and the jack.

2. The support assembly according to claim 1, wherein the repetition lever has an extension portion, and the first contact portion is included in one end of the extension portion of the repetition lever.

3. The support assembly according to claim 1, wherein the jack has a jack extension portion, and the second contact portion is included in the jack extension portion.

4. The support assembly according to claim 3, wherein the second contact portion in the jack extension portion is disposed on an extension line connecting a rotation center of the repetition lever and a portion where the jack crosses the repetition lever.

5. The support assembly according to claim 1, wherein the repetition lever has an extension portion, the first contact portion is included in one end of the extension portion of the repetition lever, the jack has a jack extension portion, and the second contact portion is included in the jack extension portion.

6. The support assembly according to claim 1, wherein the first contact portion and the second contact portion make contact with the same surface of the common regulating portion which regulates rotation of the repetition lever and the jack.

7. The support assembly according to claim 1, wherein the first contact portion and the second contact portion are disposed on a radius connecting a rotation center of the support and the common regulating portion which regulates rotation of the repetition lever and the jack.

8. The support assembly according to claim 1, wherein the repetition lever and the jack are provided so that one of the repetition lever and the jack interposes another thereof in at least a portion where the first contact portion and the second contact portion overlap each other.

9. The support assembly according to claim 1, wherein the extension portion of the repetition lever and the jack are disposed in sliding contact with each other in at least one location.

10. The support assembly according to claim 3, wherein the extension portion of the repetition lever and the jack extension portion are disposed in sliding contact with each other in at least one location.

11. A keyboard apparatus comprising:

a plurality of support assemblies, each of the plurality of support assemblies having a support rotatable along a first surface with respect to a frame, a repetition lever rotatable on the support, and a jack rotatable on the support, the repetition lever including a first contact portion which regulates a rotating operation of the repetition lever, the jack including a second contact portion which regulates a rotating operation of the lack, and the first contact portion and the second contact portion making contact with a common regulating portion to regulate the rotating operations of the repetition lever and the jack; and keys disposed to respectively correspond to the plurality of support assemblies to rotate the support assemblies.

12. The keyboard apparatus according to claim 11, wherein the repetition lever has an extension portion, and the first contact portion is included in one end of the extension portion of the repetition lever.

13. The keyboard apparatus according to claim 11, wherein the jack has a jack extension portion, and the second contact portion is included in the jack extension portion.

14. The keyboard apparatus according to claim 13, wherein the second contact portion in the jack extension portion is disposed on an extension line connecting a rotation center of the repetition lever and a portion where the jack crosses the repetition lever.

15. The keyboard apparatus according to claim 11, wherein the repetition lever has an extension portion, the first contact portion is included in one end of the extension portion of the repetition lever, the jack has a jack extension portion, and the second contact portion is included in the jack extension portion.

16. The keyboard apparatus according to claim 11, wherein the first contact portion and the second contact portion make contact with the same surface of the common regulating portion which regulates rotation of the repetition lever and the jack.

17. The keyboard apparatus according to claim 11, wherein the first contact portion and the second contact portion are disposed on a radius connecting a rotation center of the support and the common regulating portion which regulates rotation of the repetition lever and the jack.

18. The keyboard apparatus according to claim 11, wherein the repetition lever and the jack are provided so that one of the repetition lever and the jack interposes another thereof in at least a portion where the first contact portion and the second contact portion overlap each other.

19. The keyboard apparatus according to claim 11, wherein the extension portion of the repetition lever and the jack are disposed in sliding contact with each other in at least one location.

20. The keyboard apparatus according to claim 13, wherein the extension portion of the repetition lever and the jack extension portion are disposed in sliding contact with each other in at least one location.

* * * * *